US005644857A

United States Patent [19]

Ouellette et al.

[11] Patent Number: 5,644,857

[45] Date of Patent: Jul. 8, 1997

[54] GOLF SHOES WITH INTERCHANGAEABLE SOLES

[76] Inventors: Ryan R. Ouellette, 1628 Calle Plumerias; James M. Rice, 165 S. El Camino Real, Suite K, both of Encinitas, Calif. 92024; Dan Gomez, 3535 Chauncey Rd., Oceanside, Calif. 92056

[21] Appl. No.: 644,173

[22] Filed: May 10, 1996

[51] Int. Cl.[6] ..... A43C 13/00

[52] U.S. Cl. ..... 36/15; 36/42; 36/127

[58] Field of Search ..... 36/15, 136, 61, 36/62, 42, 127, 25 R, 100, 101, 135

[56] References Cited

U.S. PATENT DOCUMENTS

| | | | |
|---|---|---|---|
| 504,660 | 9/1893 | Blandy | 36/15 |
| 1,749,351 | 3/1930 | McQueen . | |
| 2,233,250 | 2/1941 | Easton | 36/42 |
| 2,368,960 | 2/1945 | Anson . | |
| 2,528,951 | 11/1950 | Epsztejn | 36/15 |
| 3,318,026 | 5/1967 | Antelo | 36/42 |
| 3,538,628 | 11/1970 | Einstein, Jr. | 36/368 |
| 3,685,174 | 8/1972 | Artle | 36/7.6 |
| 3,982,336 | 9/1976 | Herro | 36/15 X |
| 4,214,384 | 7/1980 | Gonzalez | 36/42 |
| 4,363,177 | 12/1982 | Boros | 36/101 |
| 4,377,042 | 3/1983 | Bauer | 36/15 X |
| 4,807,372 | 2/1989 | McCall | 36/135 |
| 4,936,028 | 6/1990 | Posaki | 36/15 |
| 5,269,080 | 12/1993 | Davis | 36/61 X |
| 5,317,822 | 6/1994 | Johnson | 36/101 |
| 5,373,649 | 12/1994 | Choi | 36/42 |
| 5,419,060 | 5/1995 | Choi | 36/42 X |
| 5,497,565 | 3/1996 | Balgin | 36/61 |

*Primary Examiner*—B. Dayoan
*Attorney, Agent, or Firm*—Tom Hamill

[57] ABSTRACT

An athletic shoe is provided having a plurality of interchangeable soles which may be attached or removed by a push-button spring release mechanism located on the heel. This push-button element, when actuated, permits the interchangeable sole to be removed or attached. In the preferred embodiment, this push-button element causes a pair of flexible spring type capture elements to flex, permitting a pin member located on the sole to either be inserted or withdrawn. The shoe and sole have a plurality of other novel interfitting elements and mechanisms which permit the sole to be securely affixed to the shoe as well as prevent any movement of the sole with respect to the shoe. Shoe soles may be provided which have a variety of cleats, treads or other designs which may be utilized for diverse uses such as sport or leisure. By utilizing the invention, one may employ one shoe for a variety of athletic or other activities by simply attaching the desired sole.

13 Claims, 9 Drawing Sheets

GOLF SHOES WITH INTERCHANGAEABLE SOLES

BACKGROUND OF THE INVENTION

1. Field of the Invention

The present invention relates generally to athletic shoes, and more particularly, to an athletic shoe with a plurality of attachable soles, where the soles may be quickly and easily attached. A push-button mechanism is provided which is especially adapted to effect the release and attachment of the soles.

2. Description of the Prior Art

Athletic shoes are often provided with cleats depending from the underside of the sole to prevent the shoe from slipping on a surface of the ground. One example of such a shoe is a golf shoe, which includes the aforementioned cleated elements. The cleated elements do provide stability while on the golf course, as the cleats engage the soft, penetrable surface of the ground. However, when the player leaves the course or field, the shoes must be removed before the player can walk with ease on a hard surface such as asphalt, concrete, or on a floor of a dwelling or commercial establishment. Without removal of the cleated shoes, the player may slip, disfigure the floor, or damage the cleats, it has also become common for golf courses to require golfers to not wear metal type cleats thus causing the golfer to carry an additional set of shoes to accommodate the various regulations. Various means have been employed in the past to solve this problem. Complex mechanisms for the withdraw of the cleats into the shoe have been proposed. Also, flexible elements which have a plurality of cleat receiving apertures, for covering the cleats have also been employed.

In a broader sense, the expense of shoes for the athletically minded individual is great. A different pair of shoes may currently be required for golf, soccer, running, walking, cycling, bowling, boating and other sport and leisure activities. This would incur a great expense. By employing the current invention, one may select and attach a sole to a shoe for any given activity through the use of a shoe which has a means to attach or exchange any of a plurality of soles. This would permit the user to more affordably participate in any of a variety of sports or leisure activities. In this manner, one could fulfill the requirements of an athlete without having to buy many expensive sports shoes.

Thus, while the prior art indicates it to be well known to use means to cover or withdraw the cleats, the provision of a cleated sole which may be easily removed and replaced by a walking shoe sole has not been contemplated. Nor does the prior art described above teach or suggest a push-button mechanism located in the heel of the shoe which, when actuated, permits the quick and efficient removal of the cleated sole and subsequent attachment of a shoe sole or visa versa. The push-button, located on the rear of the midsole, when actuated, causes a pair of flexible spring type elements to flex, permitting a pin member located on the sole to either be inserted or withdrawn. The shoe and sole have a plurality of other interfitting elements and mechanisms which permit the sole to be securely affixed to the shoe. Other soles may be provided which have a variety of treads, cleats and designs which may be utilized for other diverse uses. Tread designs may be configured to be applicable to any sport. These soles may be simply attached to the shoe to fit the desired activity. By utilizing the invention, the user may employ one shoe for a variety of athletic or other activities. If a sole is damaged or worn it is simply replaced with another. Other advantages of the present invention over the prior art also will be rendered evident.

SUMMARY OF THE INVENTION

To achieve the foregoing and other advantages, the present invention, briefly described, provides an athletic shoe having a plurality of interchangeable soles. Each of the interchangeable soles is detachably attached to the body of the shoe. The detachable sole has a variety of interlocking and interfitting mechanisms which both securably attaches the sole as well as permits the sole to be easily attached and removed. A push-button release mechanism is located on the heel of the midsole. This push-button element, when actuated, permits the interchangeable sole to be removed or attached. The push-button actuates a mechanism which, in the preferred embodiment, causes a pair of flexible spring type elements to flex, permitting a pin member located on the sole to either be inserted or withdrawn. The shoe and sole have a plurality of other novel interfitting elements and mechanisms which permit the sole to be securely affixed to the shoe. Shoe soles may be provided which have a variety of cleats, treads or other designs which may be utilized for diverse uses such as sport or leisure. These soles may be simply and efficiently attached to the shoe to fit any desired athletic or other activity. By utilizing the instant invention, one may employ one shoe for a variety of athletic or other activities by simply attaching the appropriate sole If the sole is damaged or worn it is simply replaced with another. A plurality of tread designs may be manufactured for any of a variety of activities. Also, a plurality of cleat configurations may be placed on the variety of interchangeable soles with different sport applications in mind as well as personal choice of a preferred cleat configuration. It is also well known that a variety of cleats are available for different playing field conditions. The instant invention would allow a player to replace the cleats simply by utilizing a replaceable sole of the current invention with the appropriate cleat size attached. When utilized, the instant invention gives the appearance of an ordinary sport shoe, with no extra height or dimension provided by the addition of the removable sole.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a shoe with interchangeable soles which may be quickly and efficiently attached or removed through the use of a push-button mechanism.

It is another object of the present invention to provide a shoe and a sole with interfitting mating means which would permit a sole to be securely affixed to the shoe in a quick and efficient fashion.

It is another object of the present invention to provide a plurality of soles with the aforementioned interfitting mating means which have a wide variety of cleats, treads, or designs, which may be utilized in sports such as golf, soccer, football, cycling, walking, running, bowling and leisure.

It is another object of the present invention to provide a shoe with interchangeable soles which may be easily and efficiently manufactured and marketed.

It is a further objective of the present invention to provide a shoe with interchangeable soles which is of durable and reliable construction.

An even further object of the present invention is to provide a shoe with interchangeable soles which is susceptible of a low cost of manufacture with regard to both materials and labor, and which accordingly is then susceptible of low prices of sale to the consuming public, thereby making such shoes and interchangeable soles available to the buying public.

These together with still other objects of the invention, along with the various features of novelty which characterize the invention, are pointed out with particularity in the claims annexed to and forming a pad of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved shoe with interchangeable soles embodying the principles and concepts of the present invention will be described.

Figure 1:
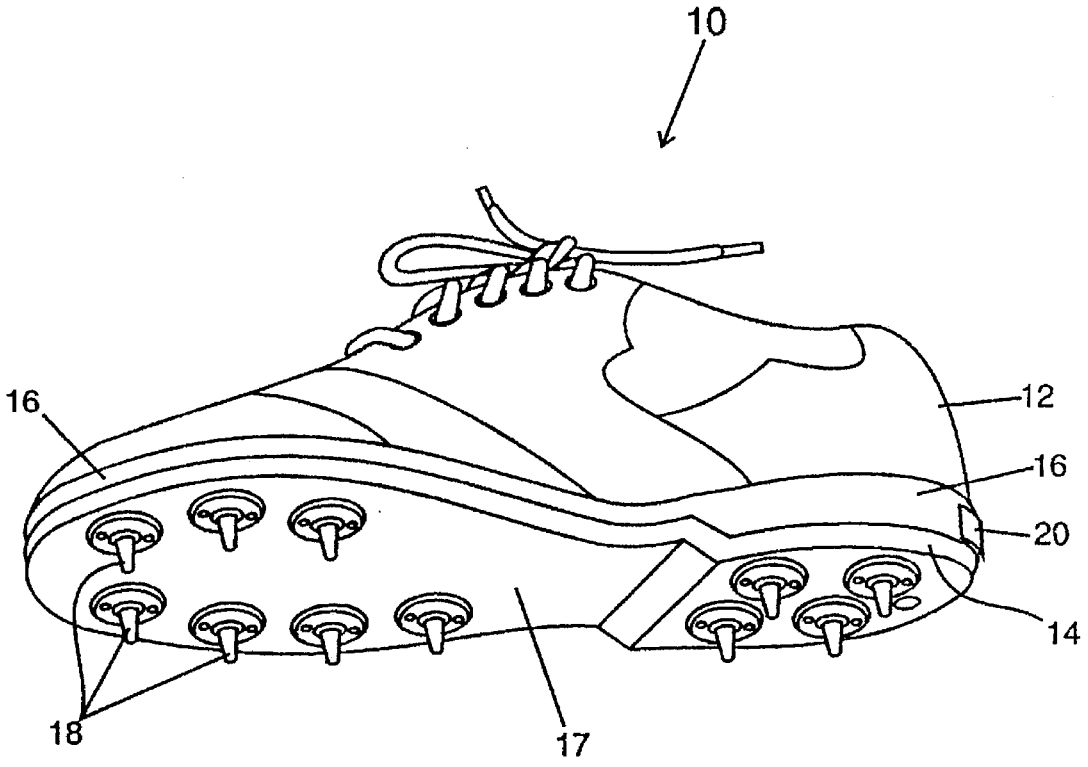
FIG. 1 is a perspective view showing an embodiment with the interchangeable sole attached to the shoe.

Turning initially to FIG. 1, there is shown a first exemplary embodiment of the invention, showing the upper shoe 12 combined with the interchangeable sole 14. The interchangeable sole 14 is made of resilient material. Intermediate the sole 14 and the upper shoe 12 is the midsole 16. The sole 14 has a bottom 17 which has a plurality of steel cleats 18 depending therefrom. It is to be understood that the bottom 17 may have other cleat patterns or tread designs, as a plurality of different soles will be available, having appropriate patterns for which ever sport shoe required. In this case, the shoe 10, defined as being the combination of the upper shoe 12, the midsole 16 and the sole 14, will be used for golfing. A push-button 20 is shown on the rear of the midsole 16. When the push-button 20 is depressed, the sole 14 may be removed from the midsole 16. The push-button 20 is spring loaded and its operation will be made clear in the discussion of the subsequent figures.

Figure 2:
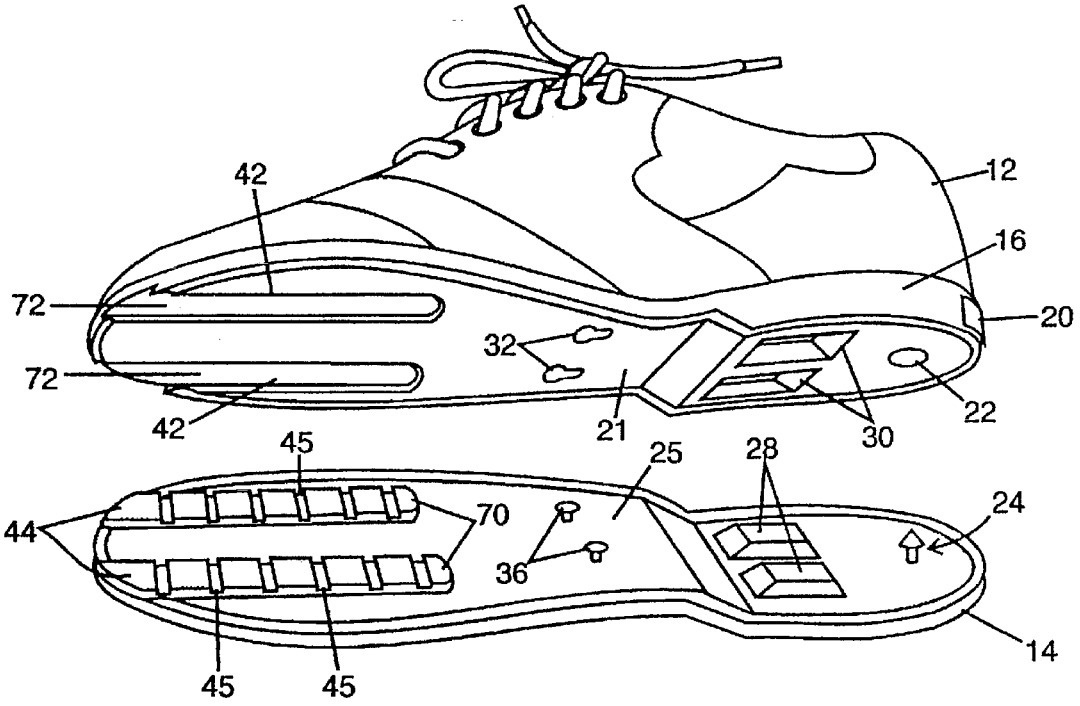
FIG. 2 is an exploded view of the interchangeable sole separated from the shoe.

Referring now to FIG. 2, the upper shoe 12 and midsole 16 are shown separated from the sole 14. The push-button 20 is shown at the rear of the midsole 16. A heel pin aperture 22 is shown proximal the push-button 20 on the underside 21 of the midsole 16. The heel pin aperture 22 is designed to receive heel pin 24 located on the top 25 of the sole 14. Heel pin 24 may freely be inserted into heel pin aperture 22 where it will matingly engage with the selectively engageable mechanism 60. The heel pin 24 may be considered to be the first male mating means, and the heel pin aperture 22 and associated structure 60 may be considered to be the first female mating means. It is to be understood that other cooperating structures may be employed, such as actuatable cams, actuatable fasteners or other selectively engageable retaining structures. When it is desirable to remove the sole 14, push-button 20 is depressed, thus freeing heel pin 24 from its mating engagement with the selectively engageable mechanism 60, and permitting the heel pin 24 to be withdrawn through the heel pin aperture 22. The structure of the securing mechanism will be made clear in the discussion of FIGS. 9 and 10.

A pair of trapezoidal shaped apertures 30 are located on the underside 21 of the midsole 16. The trapezoidal shaped apertures 30 are designed to receive trapezoidal elements 28 which are located on the top 25 of the sole 14. The trapezoidal elements 28, when matingly engaged with the trapezoidal shaped apertures 30, lend stability to the sole 14-midsole 16 interfit. This engagement will discourage side to side and forward and back slip in the sole 14-midsole 16 interfit. Although, in the preferred embodiment, solid trapezoidal elements 28 and trapezoidal apertures 30 are employed, it is obvious that other geometries may be employed as elements and apertures. They include, but are not limited to, spherical projections, tetragonal, or hexagonal elements and cooperating apertures. The trapezoidal elements 28 may be considered the second male mating means, and the trapezoidal apertures 30 may be considered the second female mating means. It is to be understood that other cooperating structures may be employed, such as fasteners, interfitting snap elements or other engageable retaining structures.

Figure 7:
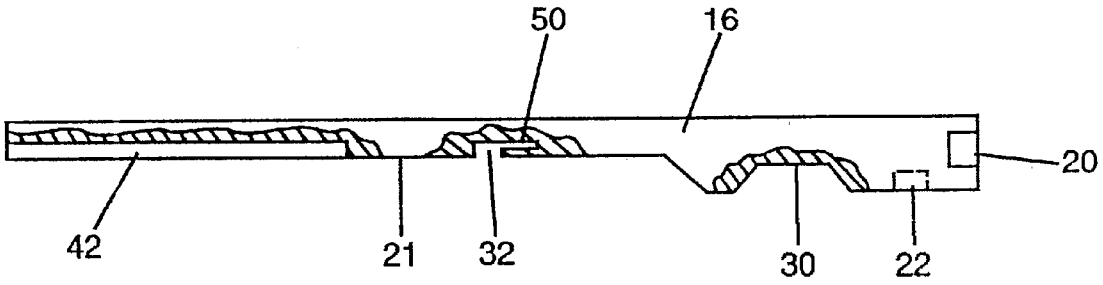
FIG. 7 is a partial sectional view taken about the side showing the female mating elements.
Figure 8:
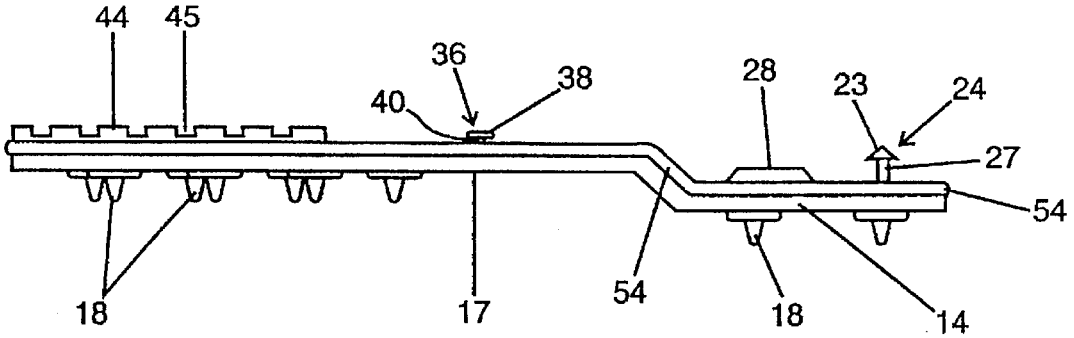
FIG. 8 is a side view of the interchangeable sole showing the male mating elements.

A pair of parallel apertures 32 are located in the approximate center of the underside 21. The parallel apertures 32 further have slots 34 extending rearwardly on the underside 21. The slots 34 have a width and a length, the length is the dimension extending in a rearward fashion. The diameter of the apertures 32 is greater than that of the dimension (width) of the slots 34. The parallel apertures 32 are designed to receive T-pins 36. The T-pins 36 are best seen in FIGS. 2 and 8. The T-pins 36 have a head 38 which is attached to a cylindrical shaft 40, the cylindrical shaft 40 being attached to the top 25 of the sole 14. In the attachment of the sole 14 to the midsole 16, the T-pins 36 would be inserted into the parallel apertures 32. The sole 14 would then be pushed in a rearward fashion, forcing the T-pins 36 to be slidingly received in slots 34. The head 38 of the T-pins 36 will be engaged in a passage 50 located above the slots 34 whereas the cylindrical shaft 40 will be contained by the slots 34. The passage 50 is best shown in FIG. 7. This mating and cooperative engagement between the T-pins 36 and the parallel aperture 32-slot 34 adds stability to the overall securement of the sole 14 to the midsole 16. This mating and cooperative engagement, along with other securing means, keeps the sole 14 securely attached to the midsole 16. It will be appreciated that other securing means may be employed other than pin-slot arrangements. The T-pins 36 and related structure may be considered to be the third male mating means. The parallel apertures 32 and related structure may be considered to be the third female mating means. It is to be understood that other cooperating structures may be employed, such as fasteners, interfitting snap elements or other engageable retaining structures.

A pair of parallel channels 42 are located on the underside 21 of the midsole 16. The channels 42 extend from the front of the midsole 16 in parallel relation and traverse the midsole 16 for a distance. The distance may vary for each individual channel, however, both will be chosen to be somewhere less than ½ the length of the sole 16. Viewed from the front, the channels 42 have the appearance of a dovetail receiving aperture. Two parallel dovetail elements 44 are located on the top 25 of the sole 14. The parallel dovetail elements 44 are designed to be received in a sliding fashion in the parallel channels 42. The parallel dovetail elements 44 are chosen to be of the same length as the parallel channels 42 so they may slidingly interfit within a minimal tolerance. The dovetail elements 44 have a plurality of orthogonally oriented grooves 45 located thereon. The grooves 45 facilitate flexibility of the sole 14. It is important that the sole 14 be resiliently flexible as it may be preferably flexed during the attachment and removal from the midsole 16. The parallel dovetail elements 44 and related structure may be considered to be the fourth male mating means. The parallel channels 42 and related structure may be considered to be the fourth female mating means. It is to be understood that other cooperating structures may be employed, such as fasteners, interfitting snap elements or other engageable retaining structures.

Figure 3:
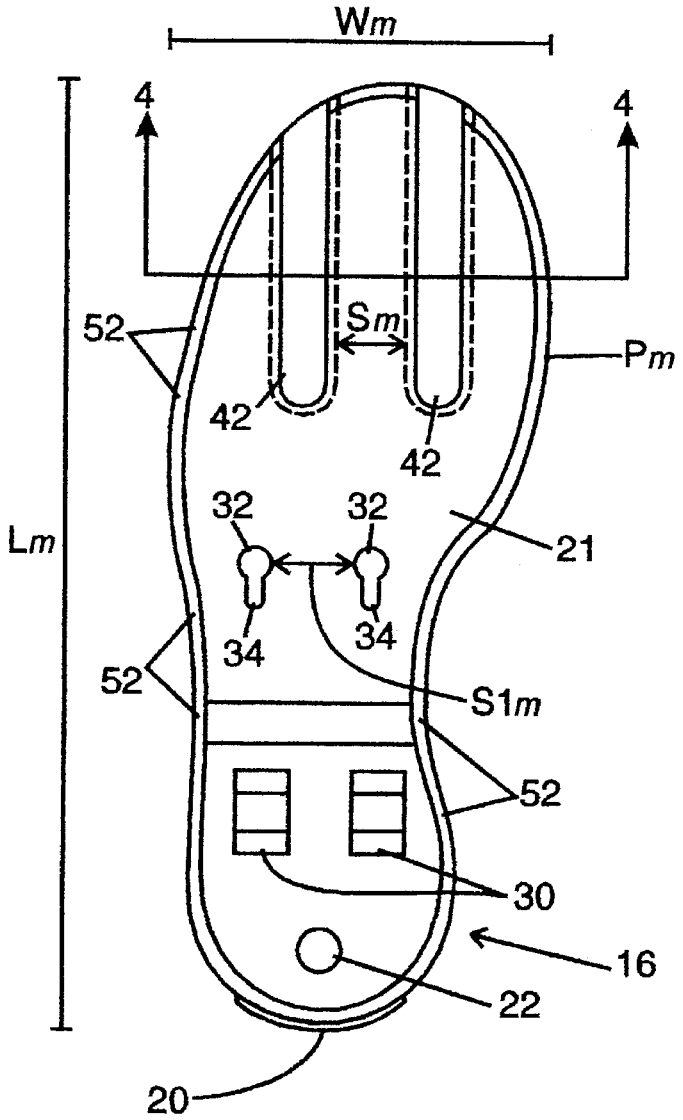
FIG. 3 is a view of the bottom of the midsole showing the female mating elements.

Referring now specifically to FIG. 3, the underside 21 of the midsole 16 is shown, detailing the general arrangement of the mating and cooperative structures located thereon. The midsole 16 has a length ($L_m$) and a width ($W_m$), the width ($W_m$) varying as a function of length ($L_m$). The midsole 16 also has a perimeter ($P_m$). It is noted that the sole 14 also has a length ($L_s$), a width ($W_s$) which varies with the length ($L_s$), and a perimeter ($P_s$). The parallel channels 42 are shown traversing a distance somewhat less than ½ the length ($L_m$) of the midsole 16. The spacing ($S_m$) between the two parallel channels 42 is optimized for maximum stability and attachment strength. The spacing ($S_m$) would be chosen to be about less than ½ the maximum width of the midsole 16. It is understood that the location and spacing of the parallel channels 42 will be chosen to reflect optimum design considering both operation and manufacture. As such, changes in location and configuration of the parallel channel structure 42 may be made. It is also understood that other means to secure the front area of the sole 14 to the midsole 16 may be provided.

A pair of parallel apertures 32 are located in the approximate center of the underside 21, preferably, about or near where $L_m=\frac{1}{2}L_m$. It is understood that the location of the apertures 32 will be chosen to reflect optimum design considering both operation and manufacture. As such, changes in location and configuration of the pair of parallel apertures 32 may be made. The parallel apertures 32 further have slots 34 extending rearwardly (toward the heel pin aperture 22) on the underside 21. The slots 34 have a width and a length, the length is the dimension extending in a rearward fashion. The diameter of the apertures 32 is greater than that of the dimension (width) of the slots 34. The aperture spacing ($S1_m$) between each one of the parallel apertures 32 will also be chosen to maximize stability, attachment strength, as well as efficiency of attaching and removal of the sole 14. Although values may vary, the aperture spacing ($S1_m$) will be selected to be about less than ¾ the minimum width of the midsole 16. The interior structure associated with the parallel apertures 32 will be addressed in the discussion of FIG. 7. It is to be understood that other means to secure the central area of the sole 14 to the midsole 16 may be provided.

A pair of trapezoidal shaped apertures 30 are located in parallel relation on the underside 21 of the midsole 16 preferably about or near where $L_m=\frac{3}{4}L_m$. It is understood that the location of the trapezoidal apertures 30 will be chosen to reflect optimum design considering both operation and manufacture. As such, changes in location and configuration of the pair of trapezoidal apertures 30 may be made. The trapezoidal elements 28, when matingly engaged with the trapezoidal shaped apertures 30, lend stability to the sole 14-midsole 16 interfit. This engagement will discourage side to side and forward and back slip in the sole 14-midsole 16 interfit. Although, in the preferred embodiment, trapezoidal apertures 30 are employed, it is obvious that other geometries may be employed as elements and apertures. They include, but are not limited to, spherical projections, tetragonal, or hexagonal elements and cooperating apertures.

A heel pin aperture 22 is located preferably at about or near the rear of the midsole 16. It is understood that the location and configuration of the heel pin aperture 22 will be chosen to reflect optimum design considering both operation and manufacture. As such, changes in location and configuration of this heel pin aperture 22 may be made. This heel pin aperture 22 will be approximately centrally disposed on the midline of the heel (rear) section of the midsole 16. Above the heel pin aperture 22 interior of the heel section of the midsole 16 is a selectively engageable mechanism 60 to securably attach and selectively release a heel pin 24. This mechanism is selectively engaged by depressing push-button 20. The details of the selectively engageable mechanism will be discussed at length during the discussion of FIGS. 9 & 10.

Figure 4:
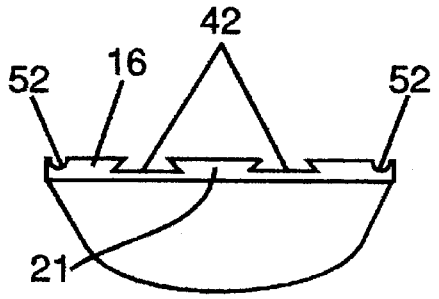
FIG. 4 is a cross-sectional view taken from lines 4—4 of FIG. 3.

FIG. 4 is a view taken along line 4—4 of FIG. 3. It shows the structure of the parallel channels 42 located on the underside 21 of the midsole 16. The parallel channels 42 are designed to receive parallel dovetail elements 44. The debris barrier receiving aperture 52 is shown. The debris barrier receiving aperture 52 generally follows and is proximal to the perimeter of the midsole ($P_m$). When the debris barrier 54 is inserted into the debris barrier receiving aperture 52, no foreign matter can enter the interior interfit region between the sole 14 and midsole 16.

Figure 5:
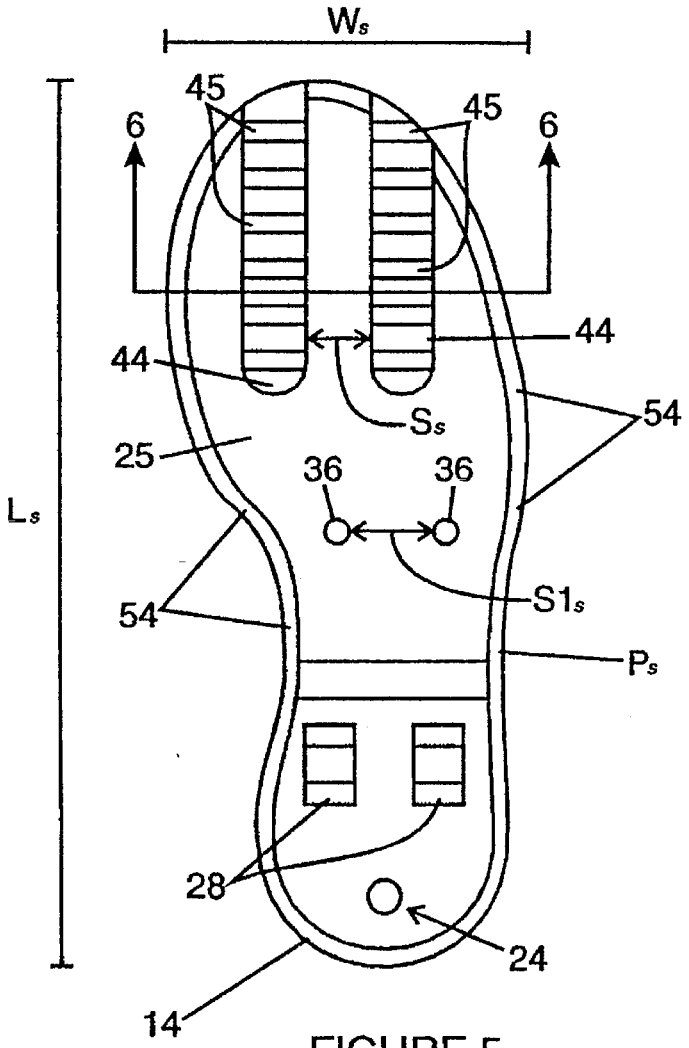
FIG. 5 is a top view of the interchangeable sole showing the male mating elements.

Referring now to FIG. 5, the top 25 of the sole 14 is shown, detailing the general arrangement of the mating and cooperative structures located thereon. The sole 14 has a length ($L_s$) and a width ($W_s$), the width ($W_s$) varying as a function of length ($L_s$). The sole 14 also has a perimeter ($P_s$). It is again noted that the midsole 16 also has a length ($L_m$), a width ($W_m$) which varies with the length ($L_m$), and a perimeter ($P_m$). It is noted that since the sole and midsole are matingly engaged, therefore the L, W, and P describe the same parameters. The parallel dovetail elements 44 are shown traversing a distance somewhat less than ½ the length ($L_s$) of the sole 14. The parallel dovetail elements 44 have a plurality of grooves 45 made thereon. The grooves 45 permit flexibility in the sole 14. The spacing ($S_s$) between the parallel dovetail elements 44 is optimized for maximum stability and attachment strength. The spacing ($S_s$) would be chosen to be about less than ½ the maximum width of the midsole 16. It is understood that the location and spacing of the parallel dovetail elements 44 will be chosen to reflect optimum design considering both operation and manufacture, as well as the location of the interfitting parallel channels 42. As such, changes in location and configuration of the parallel dovetail elements 44 may be made. It is also understood that other means to secure the front area of the sole 14 to the midsole 16 may be provided.

A pair of T-pins 36 are located in the approximate center of the top 25, preferably, about or near where $L_s$=½$L_s$. It is understood that the location of the T-pins 36 will be chosen to reflect optimum design considering both operation and manufacture, as well as the location of the apertures 32. As such, changes in location and configuration of the pair of T-pins 36 may be made. The T-pins 36 have a head 38 which is attached to a cylindrical shaft 40, the cylindrical shaft 40 being attached to the top 25 of the sole 14. The T-pin spacing ($S1_s$) between each one of the T-pins 36 will also be chosen to maximize stability, attachment strength, as well as efficiency of attaching and removal of the sole 14. Also, the position of the apertures 32 and slots 34 will be taken into account. Although values may vary, the T-pin spacing ($S1_s$) will be selected to be about less than ¾ the minimum width of the sole 14. The mating interior structure located on the midsole, which is associated with the parallel apertures 32, will be addressed in the discussion of FIG. 7. It is to be understood that other means to secure the central area of the sole 14 to the midsole 16 may be provided.

A pair of trapezoidal elements 28 are located in parallel relation on the top 25 of the sole 14 preferably about or near where $L_s$=¾$L_s$. It is understood that the location of the trapezoidal elements 28 will be chosen to reflect optimum design considering both operation and manufacture, as well as the location of the trapezoidal apertures 30. As such, changes in location and configuration of this pair of trapezoidal elements 28 may be made. The trapezoidal elements 28, when matingly engaged with the trapezoidal shaped apertures 30, lend stability to the sole 14-midsole 16 interfit. This engagement will discourage side to side and forward and back slip in the sole 14-midsole 16 interfit.

A heel pin 24 is located preferably at about or near the rear of the sole 14. It is understood that the location and configuration of the heel pin 24 will be chosen to reflect optimum design considering both operation and manufacture. As such, changes in location and configuration of this heel pin 24 may be made. The heel pin 24 will be approximately centrally disposed on the midline of the heel (rear) section of the sole 14. The heel pin 24 has a head 23, the head 23 being attached to a cylindrical element 27. The cylindrical element 27 is further attached to the top 25 of the sole 14, as explained above and shown in the figures. The head 23 has a configuration which permits it to mate with the selectively engageable mechanism 60 and will be discussed at length during the discussion of FIGS. 9 & 10.

Figure 6:
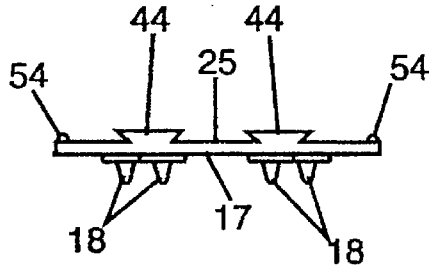
FIG. 6 is a cross-sectional view taken from lines 6—6 of FIG. 5.

FIG. 6 is a cut away view taken along line 6—6 of FIG. 5. The cleats 18 are shown on the bottom 17 of the replaceable sole 14. The pair of parallel dovetail elements 44 are located on the top 25 of the sole 14. The debris barrier 54 is also shown. The debris barrier 54 generally follows and is proximal to the perimeter of the sole ($P_s$).

Referring now to FIG. 7 a side view of the midsole 16 is shown with the female mating elements detailed. From left to right, one of the parallel channels 42, one of the parallel apertures 32, one of the passages 50, one of the trapezoidal apertures 30, the heel pin aperture 22, and the push-button 20 are shown. It is noted that the other channel, aperture, passage and trapezoidal aperture would appear the same if viewed from the other side of the midsole.

FIG. 8 is a side view of the sole 14. The bottom 17 of the sole 14 shows a plurality of cleat elements 18 attached thereto. It is understood that any known or currently unknown tread or cleat configuration may be provided on the bottom 17. The top 25 of the sole 14 includes the male mating elements. From left to right, these include one of the dovetail elements 44, one of the T-pins 36, one of the trapezoidal elements 28, and the heel pin 24. The dovetail element 44 shows a plurality of grooves 45. The T-pin element 36 shows the head 38 and the cylindrical shaft 40. The heel pin 24 shows the head 23 and the cylindrical element 27. It is noted that the other dovetail element, T-pin, trapezoidal element would appear the same if viewed from the other side of the sole.

Figure 9:
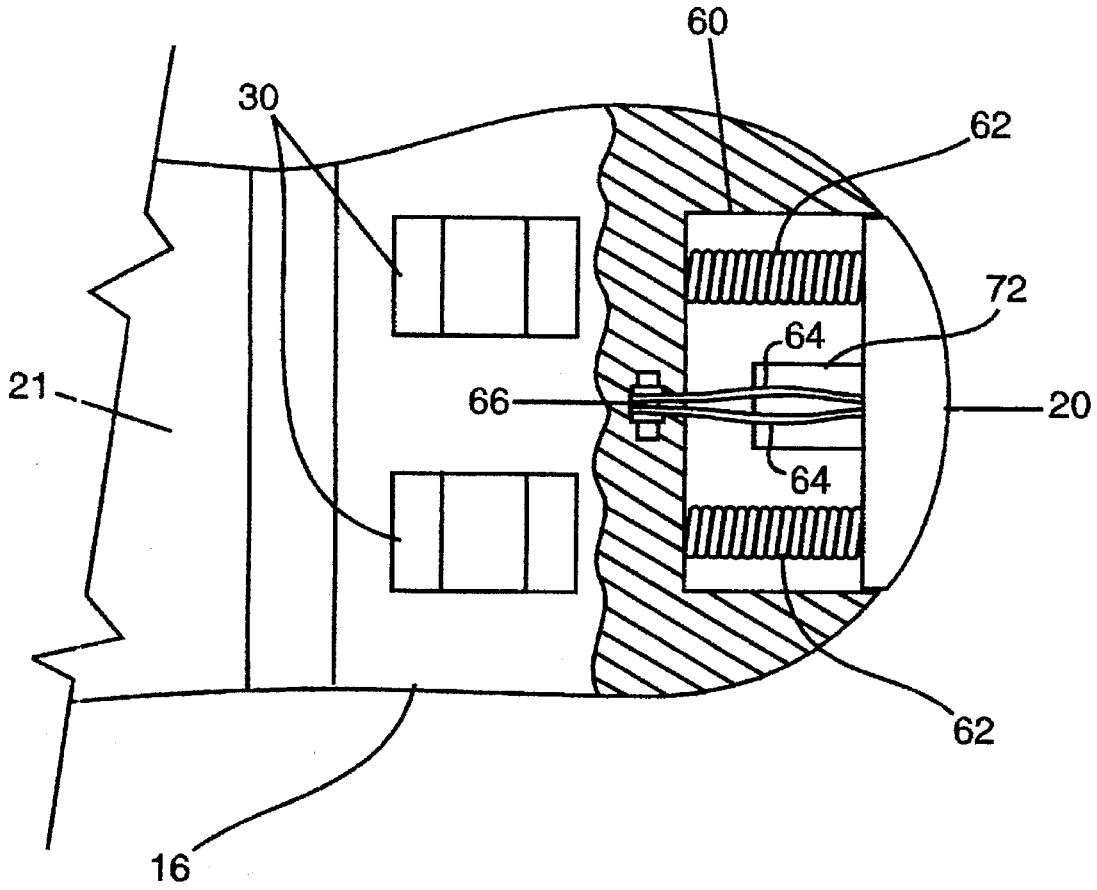
FIG. 9 is a cut away view of the push-button assembly in the unactuated (closed) position.
Figure 10:
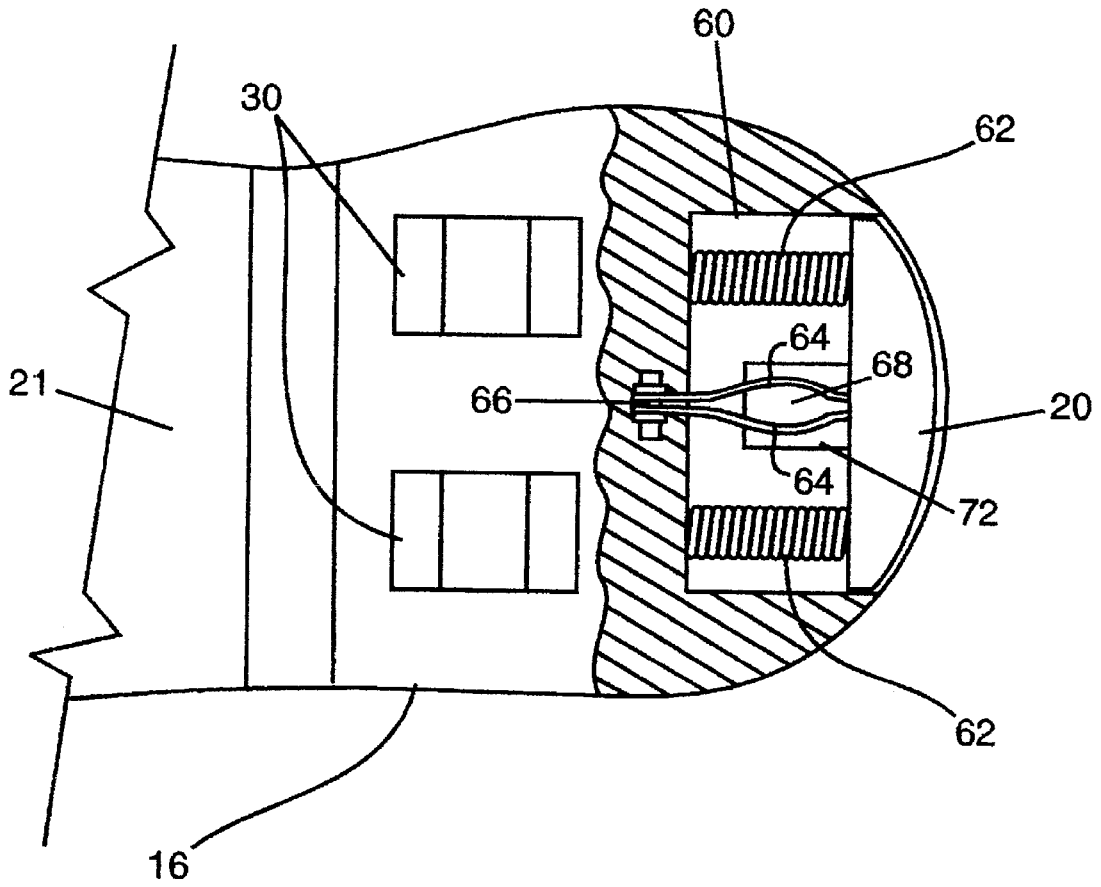
FIG. 10 is a cut away view of the push-button assembly in the actuated (open) position.

Referring now specifically to FIGS. 9 and 10 the details of the selectively engageable mechanism 60 will be discussed. The selectively engageable mechanism 60 is located interior the midsole 16 heel section in a hollowed out compartment to the rear of the trapezoidal apertures 30. The selectively engageable mechanism 60 is located above aperture 22, interior of the midsole 16 heel section to the rear of the trapezoidal apertures 30 and is shown in cut away view in FIGS. 9 and 10. A pair of springs 62 are mounted in communication with the push-button 20. These springs 62 bias, or keep the push-button 20 in an undepressed position, essentially flush to the rear perimeter of the heel of the midsole 16. This undepressed position of the push-button 20 is best shown in FIG. 9. A pair of resilient, deformable, capture arms 64 are shown centrally disposed between, and in parallel relation to the springs 62. The capture arms 64 are secured to the midsole 16 by securing means 66. The capture arms 64 flex when push-button 20 is depressed as shown in FIG. 10. A central area 68 is opened between the capture arms 64 with the push-button 20 depressed due to the flexure of the capture arms 64. The capture arms 64 are designed to retain and hold heel pin 24. The head 23 of heel pin 24 will be retained by the capture arms when the push-button 20 is undepressed. The heel pin 24 will be freed when the push-button 20 is depressed. The heel pin 24 itself may deform the capture arms 64 in a camming type style when the sole 14 is being attached to the midsole 16. The triangular shape of the head 23 of the heel pin 24 will push the two capture arms 64 apart when the heel pin 24 is being inserted through heel pin aperture 22. A leaf spring 72 cooperates with the capture arms 64. When the push-button 20 is depressed and the capture arms 64 flex, the leaf spring 72 urges the pin 24 through aperture 22.

Figure 11:
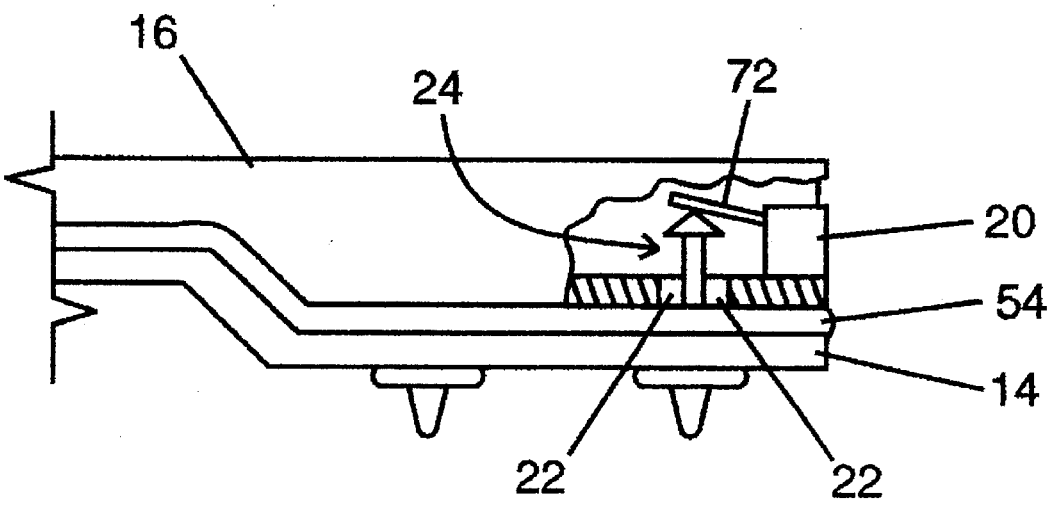
FIG. 11 is a break away of the push-button assembly as viewed from the side, with the push-button unactuated (closed) position.
Figure 12:
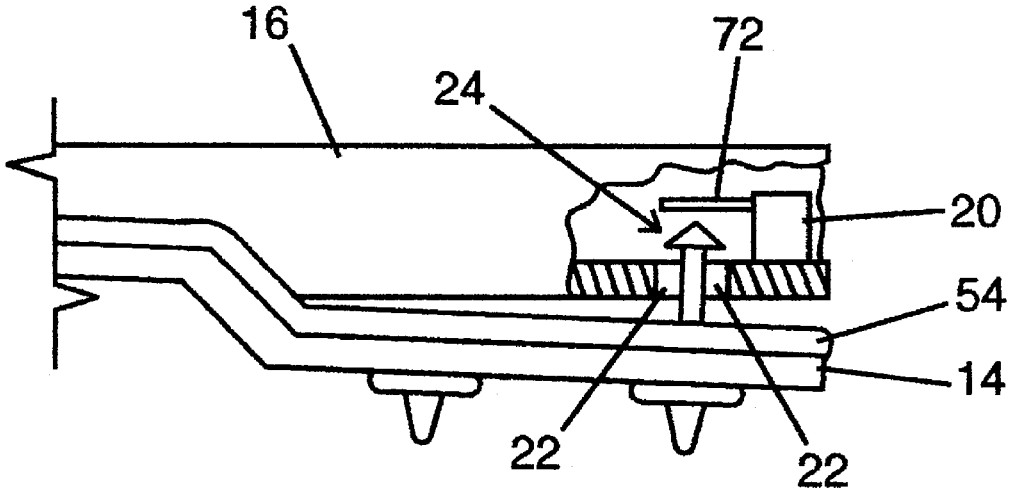
FIG. 12 is a break away of the push-button assembly as viewed from the side, with the push-button unactuated (open) position.

Referring now to FIGS. 11 and 12, a break away of the push-button mechanism is shown from the side, focusing on the internal pin ejection arrangement. FIG. 11 shows the push-button 20 in the undepressed state, with the heel pin 24 being held firmly by capture arms 64 Leaf spring 72 is in a biased position exerting a downward force against the heel pin 24. The heel pin 24 is prevented from exiting aperture 22 because it is being held by the capture arms 64. Note that capture elements 64 and springs 62 are not shown in FIGS. 11 and 12 to facilitate clarity of the ejection structure. FIG. 12 shows the push-button 20 in the depressed state, with the heel pin 24 having been ejected by the leaf spring 72. When the push-button 20 is depressed, the springs 62 exert an outward force against the depression. Therefore, if the push-button 20 is released, the springs 62 will urge the push-button to its neutral position. The push-button 20, when depressed, causes the capture arms 64 to flex forming a central area 68 between the right and left capture arms. The leaf spring 72, is then permitted to urge (eject) the heel pin 24 in a downward fashion, when the capture arms 64 flex, due to the fact that the capture arms 64 are no longer engaging the heel pin 24. This permits the heel pin 24 to be inserted or withdrawn from the interior area above aperture 22. Also, note that the head of the heel pin 24 is so configured as to permit the heel pin 24 to be inserted into the space 68 by pushing the capture arms 64 apart. When the push-button 20 is depressed, the springs 62 exert an outward force against the depression. Therefore, if the push-button 20 is released, the springs 62 will urge the push-button to its neutral position. The push-button 20, when depressed, causes the capture arms 64 to flex forming a central area 68 between the right and left capture arms. The leaf spring 72, is then permitted to urge (eject) the heel pin 24 in a downward fashion, when the capture arms 64 flex, due to the fact that the capture arms 64 are no longer engaging the heel pin 24. This permits the heel pin 24 to be inserted or withdrawn from the interior area above aperture 22. Also, note that the head of the heel pin 24 is so configured as to permit the heel pin 24 to be inserted into the space 68 by pushing the capture arms 64 apart. Note the central area 68 is best seen in FIG. 10.

Method of Attachment of Soles to Midsoles

The soles 14 are attached to the midsole 16 by the following method. The rear 70 of the parallel dovetail elements 44 are inserted into the front 72 of the parallel channels 42, and are slid into the parallel channels 42. They are slid until the head of T-pins 36 are directly below parallel apertures 32. The T-pins 36 are inserted into apertures 32 and then slid into the receiving channels 50. This brings the parallel dovetail elements 44 and the parallel channels 42 into full mating interfit. In this fashion, the spacing between the center of the midsole 16 and the sole 14 is eliminated. It will be appreciated that the sole 14 is flexible and may be flexed or bent during this process. Next the trapezoidal elements 28 will be received in trapezoidal apertures 30. Finally, the heel pin 24 will be inserted through the heel pin aperture 22. The head 23 of the heel pin 24 will come into contact with the capture arms 64. The head 23, by its shape, will deform the capture arms 64 as it is being inserted. Once the head 23 has passed through the capture arms 64, the capture arms 64 will deform back to their original configuration, capturing the heel pin 24 in a secure fashion. Debris barrier 54 will be mated with debris barrier channel 52, and the shoe 12 will be completely assembled. The sole 14 is removed from the midsole 16 easily by depressing the push-button 20. By depressing the push-button 20, the capture arms 64 are caused to flex releasing the heel pin 24. Leaf spring 72 ejects the heel pin 24 from the aperture 22. The sole 14 is removed by the inverse of the above detailed process.

It is apparent from the above that the present invention accomplishes all of the objectives set forth by providing a new and improved shoe with interchangeable soles which may be quickly and efficiently attached or removed through the use of a push-button mechanism.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A shoe including a removable sole comprising, an upper shoe portion, a midsole permanently attached to the underside of the upper shoe portion, said midsole having a bottom, said bottom including a rear portion, a first female mating means, said first female mating means located proximal said rear portion, said first female mating means having a open position and a neutral position, said first female mating means further being connected to a push-button, said first female mating means being selectively operable between said open position and said neutral position by the actuation of said push-button, a removable sole, said sole including an upper side and a lower side, said upper side including a first male mating means, said first male mating means to be received in said first female mating means, whereby said first male mating means is secured within said first female mating means when said first female mating means is in the neutral position and then, when said push-button is engaged, said first female mating means is in said open position, permitting said first male mating means to be inserted or removed.

2. A shoe including a removable sole as claimed in claim 1 wherein said push-button has a first portion and a second portion, said first portion resides on the rear midsole of said shoe, and said second portion resides in the interior of said midsole, said second portion further including an ejection means connected thereto, said ejection means urging said first male mating means from said first female mating means when said push-button is engaged.

3. A shoe including a removable sole as claimed in claim 1 wherein said bottom of said midsole includes a second female mating means, and said upper side of said sole includes a second male mating means, said second male mating means to be received within said second female mating means, whereby said midsole and said sole will be securely, yet removably attached about said second male mating means and said second female mating means.

4. A shoe including a removable sole as claimed in claim 3 wherein said bottom of said midsole includes a third female mating means, and said upper side of said sole includes a third male mating means, said third male mating means to be received and slidingly interfit within said third female mating means, whereby said midsole and said sole will be securely, yet removably attached about said third male mating means and said third female mating means.

5. A shoe including a removable sole as claimed in claim 4 wherein said bottom of said midsole includes a fourth female mating means, and said upper side of said sole includes a fourth male mating means, said fourth male mating means to be slidingly received in said fourth female mating means, whereby said midsole and said sole will be securely, yet removably attached about said fourth male mating means and said fourth female mating means.

6. A shoe including a removable sole as claimed in claim 1 wherein said first female mating means includes a pair of deformable capture elements, and said first male mating means includes a pin with a head, said deformable capture elements capturing said head within said first female mating means in an interlocked fashion when said pin is inserted therein.

7. A shoe including a removable sole as claimed in claim 6 wherein said pair of deformable capture elements are urged apart by the depression of said push-button, permitting the removal of said head, thus allowing the removal of said sole from said midsole.

8. A shoe including a removable sole as claimed in claim 5 wherein said lower side includes a surface having a tread.

9. A shoe including a removable sole as claimed in claim 5 wherein said lower side includes a surface having a plurality of cleats.

10. A shoe including a removable sole as claimed in claim 5 wherein said second male mating means includes a pair of trapezoidal elements, and said second female mating means includes a pair of trapezoidal apertures, said apertures to receive said elements.

11. A shoe including a removable sole as claimed in claim 5 wherein said third male mating means includes a pair of pins, and said third female mating means including a pair of pin receiving apertures in communication with a pair of slots, said pin receiving apertures to receive said pins, and said slots to further receive said pins.

12. A shoe including a removable sole as claimed in claim 5 wherein said fourth male mating means includes a pair of elongated dovetail elements, and said fourth female mating means includes a pair of elongated channels, said channels to slidingly receive said elements.

13. A shoe including a removable sole as claimed in claim 2 wherein said ejection means includes a leaf spring.

* * * * *